United States Patent [19]

Klukos

[11] Patent Number: 4,566,592

[45] Date of Patent: Jan. 28, 1986

[54] DECORATIVE PACKAGE

[76] Inventor: Colette M. Klukos, 10030 - 152nd St., West Olive, Mich. 49460

[21] Appl. No.: 657,181

[22] Filed: Oct. 3, 1984

[51] Int. Cl.[4] ..... B65D 85/62

[52] U.S. Cl. ..... 206/449; 206/215; 206/232; 206/575; 206/451

[58] Field of Search ..... 206/449, 575, 232, 451, 206/215; 229/46

[56] References Cited

U.S. PATENT DOCUMENTS 566,821 9/1896 Van Alstine ..... 229/46

2,771,237 11/1956 Philipson ..... 229/46

*Primary Examiner*—William T. Dixson, Jr.

*Assistant Examiner*—Brenda J. Ehrhardt

*Attorney, Agent, or Firm*—Price, Heneveld, Huizenga & Cooper

[57] ABSTRACT

A package is made of a foldable, relatively thin material such as fiberboard folded to define an open sided envelope surrounded by a decorative ribbon secured to at least one of the side panels of the container to sandwich and hold planar objects such as cards.

9 Claims, 6 Drawing Figures

DECORATIVE PACKAGE

BACKGROUND OF THE INVENTION

The present invention relates to a decorative package and one particularly for planar objects such as cards.

Cards, such as greeting cards or the like, are typically packaged in small, fiberboard cartons with, in many instances, clear plastic covers. Although such packaging provides adequate protection for the cards for shipment and display, the packaging is somewhat expensive and not particularly attractive.

With special cards, such as art lithographs, it is desired to provide an attractive, artistic packaging and yet maintain the expense at a reasonable level. Also, with such artisan cards, it is desired to provide a unique and decorative package which stands out from customary packaging cartons.

SUMMARY OF THE PRESENT INVENTION

The package of the present invention provides these objectives by providing a folded, planar protective cover of generally U-shaped configuration and made of a foldable, relatively thin material such as fiberboard. The open sided envelope thus formed is surrounded by a decorative ribbon secured to at least one of the side panels of the container to sandwich and hold the cards. In the preferred embodiment of the invention, the ribbon is prevented from slipping from the package by providing at least one tab formed on one side of the envelope such that the ribbon cannot shift laterally. Such a package provides an attractive, decorative container for cards and yet is inexpensive and provides protection for the cards and envelope held by the package.

These and other objects, features and advantages of the present invention can best be understood by referring to the following description thereof together with reference to the accompanying drawings in which:

DETAILED DESCRIPTION OF THE PREFERRED EMBODIMENT

Figure 1:
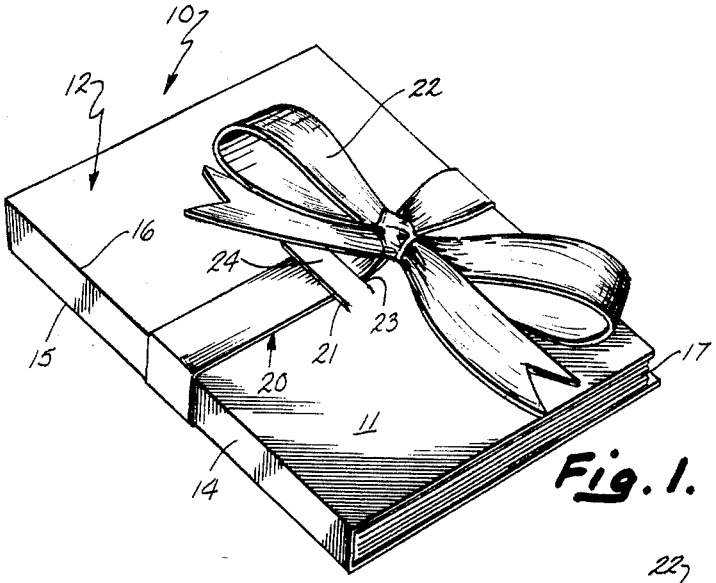
FIG. 1 is a perspective view of the package of the present invention.
Figure 4:
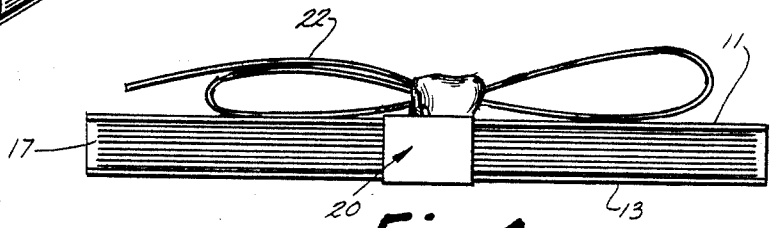
FIG. 4 is a right side elevational view of the structure shown in FIG. 2.
Figure 2:
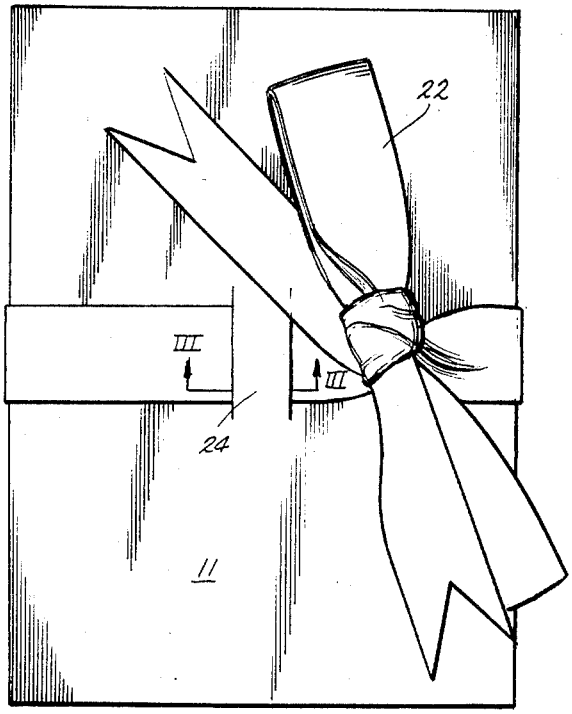
FIG. 2 is a top plan view of the structure shown in FIG. 1.

Referring to the Figures, there is shown a decorative package 10 embodying the present invention and which comprises a planar sheet 12 of foldable material, such as fiberboard. In the preferred embodiment, fiberboard having a thickness of 0.015 inches was employed. The generally elonated, rectangular sheet 12 is folded to define an envelope-like cover having a pocket for receiving planar objects. In the preferred embodiment, sheet 12 is folded in an elongated U-shaped configuration having two facing panels 11 and 13 integrally joined at adjacent edges by integral base section 14 along fold lines 15 and 16. The depth of base 14 is selected to accommodate the number of planar objects, such as cards 17, to be held within the package.

Figure 3:
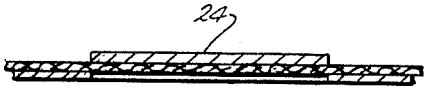
FIG. 3 is an enlarged, fragmentary, cross-sectional view, taken along section line III—III of FIG. 2.
Figure 6:
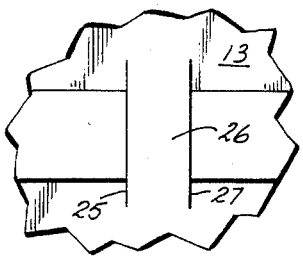
FIG. 6 is a fragmentary, bottom plan view of the structure shown in FIG. 2.
Figure 5:
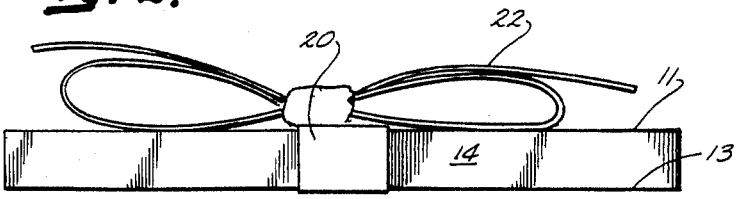
FIG. 5 is a left side elevational view of the structure shown in FIG. 2.

The package 10 surrounds three sides of the stacked planar objects 17 to be held and is held in a closed position shown by a binding strip 20 which, in the preferred embodiment of the invention, is a flat, decorative ribbon tied with a bow 22. In order to anchor binding member 20 in position with respect to at least one of the panels 11 or 13 or, as in the preferred embodiment, both panels 11 and 13, a pair of parallel slits 21 and 23 are provided in panel 11 and 25 and 27 are provided in panel 13 at the approximate center of each of the respective panels. The pairs of parallel slits thus define tabs 24 and 26 underwhich the ribbon is captively held, as best seen in FIG. 3, preventing the ribbon from slipping off of the package.

Sheet 12 forming the package is folded along lines 15 and 16 in a conventional manner either manually or by a suitable mechanized process. In the preferred embodiment, where cards and envelopes having a general dimension of 4.25 by 5.50 inches, the overall sheet size was 9.25 inches long and had a width of 6 inches thus providing sufficient overlap along the edges of the cards to provide protection therefor. The resultant panels 11 and 13 each had a width of 6 inches and a length of approximately 4.50 inches with the depth of section 14 being approximately 0.50 inches. Ribbon 20 is slid under tabs 24 and 26 prior to the tying of bow 22 which can be done with the cards in place or the cards can be slid in from either of the package ends once the bow is tied. The bow can be slid to a position adjacent slot 23 to at least partially conceal tab 24. The bow is shown in a somewhat displaced position in the drawings to clearly show the ribbon holding tab.

The fiberboard employed for sheet 12, in the preferred embodiment, was a dark gray color with ribbon 22 being a burgandy color although any number of decorative, complementary colors for the panel and ribbon can be employed. The ribbon, in the preferred embodiment, had a width of approximately 1 inch and a length suitable to provide a bow proportionate to the packaging, as illustrated. The slits 21, 23, 25 and 27 were approximately 1.50 inches in length and were spaced to define a tab approximately 0.50 inches wide for supporting the ribbon thereunder. In the embodiment shown, with the dimensions illustrated, five cards and associated envelopes were contained in the package. In other embodiments of the invention, decorative yarn or the like can be employed as the binding means and the width of the slits defining the tab or tabs can be varied to accommodate the particular binding medium being employed. The binding means thus holds the panels 11 and 13 in parallel facing and spaced relationship compressibly holding the cards therein as well as enclosing the end opposite panel 14 to prevent the cards from falling out in the transverse direction, i.e., in the direction of the axis of the binding means.

These and other modifications of the preferred embodiment as disclosed herein can be made by those skilled in the art without departing from the spirit or scope thereof as defined by the appended claims.

The embodiment of the invention in which an exclusive property or privilege is claimed are defined as follows:

1. A decorative package for planar objects such as cards comprising:

a first panel and a second panel joined along an adjacent edge of each panel to define a pocket between said panels, said first panel having joined edge joined to said second panel and a free edge opposite said joined edge;

binding means surrounding said panels in a direction orthogonal to said edges for holding the panels together and confining objects placed in the pocket, said binding means including an elongated binding element having two ends, said two ends tied in a decorative bow adjacent said first panel; and said first panel including two spaced apertures therethrough said apertures defining tab means therebetween, said binding element extending under said tab means, and said decorative bow being disposed between said free edge and said apertures and adjacent said apertures.

2. The apparatus as defined in claim 1 wherein said panels are integrally formed from a sheet of foldable material folded along said adjacent edges.

3. The apparatus as defined in claim 2 wherein said apertures comprise a pair of parallel spaced slits formed through said at least one panel.

4. The apparatus as defined in claim 3 wherein said binding means comprises a ribbon.

5. The apparatus as defined in claim 4 wherein said sheet is folded twice to form a base between said panels, said base having a dimension selected to conform to the thickness of the objects to be held by said package.

6. The apparatus as defined in claim 5 wherein each of said panels includes a pair of centrally located parallel spaced slits.

7. The apparatus as defined in claim 6 wherein said sheet is made of fiberboard.

8. The apparatus as defined in claim 7 wherein said fiberboard has a thickness of about 0.015 inches.

9. The apparatus as defined in claim 1, wherein said two spaced apertures comprise a first set of spaced apertures, further comprising a second set of two spaced apertures through one of said panels, with said decorative bow being disposed between said first set of apertures and said second set of apertures.

* * * * *